US010989152B2

(12) United States Patent
Ravindranath

(10) Patent No.: US 10,989,152 B2
(45) Date of Patent: Apr. 27, 2021

(54) SYSTEMS AND METHOD FOR EXHAUST GAS RECIRCULATION

(71) Applicant: Transportation IP Holdings, LLC, Norwalk, CT (US)

(72) Inventor: Balaji Hosadurgam Ravindranath, Bangalore (IN)

(73) Assignee: TRANSPORTATION IP HOLDINGS, LLC, Norwalk, CT (US)

( * ) Notice: Subject to any disclaimer, the term of this patent is extended or adjusted under 35 U.S.C. 154(b) by 0 days.

(21) Appl. No.: 16/360,868

(22) Filed: Mar. 21, 2019

(65) Prior Publication Data

US 2019/0219004 A1 Jul. 18, 2019

Related U.S. Application Data

(62) Division of application No. 15/241,255, filed on Aug. 19, 2016, now Pat. No. 10,280,878.

(51) Int. Cl.
*F02M 26/33* (2016.01)
*F02M 26/27* (2016.01)
*F02M 26/52* (2016.01)

(52) U.S. Cl.
CPC ..... *F02M 26/33* (2016.02); *F02M 26/27* (2016.02); *F02M 26/52* (2016.02)

(58) Field of Classification Search
CPC ..... F02M 26/33; F02M 26/52; F02M 26/27; F02M 26/43; F02M 2026/004; F02M 31/083; F02M 26/25; F02M 26/26; F02M 26/22–33; F02D 41/0077; F02D 41/0047; F02D 41/0065; F02D 2200/023; F02D 2041/0067; F02D 2041/007; F02D 41/1454; F02D 2200/0418; F02D 2200/0802; F02D 41/1446; F02D 41/1447; F02D 2200/08
See application file for complete search history.

(56) References Cited

U.S. PATENT DOCUMENTS

| | | | | |
|---|---|---|---|---|
| 5,617,726 | A * | 4/1997 | Sheridan | F02B 37/18 60/605.2 |
| 6,971,377 | B2 * | 12/2005 | Moyer | F02M 26/25 123/568.12 |
| 6,978,772 | B1 | 12/2005 | Dorn et al. | |
| 7,451,748 | B2 | 11/2008 | Nigoro et al. | |
| 8,746,217 | B2 | 6/2014 | Piper et al. | |
| 2006/0278204 | A1 * | 12/2006 | Hatano | F02M 26/67 123/568.12 |
| 2007/0028902 | A1 * | 2/2007 | Nigoro | F02M 26/28 123/568.12 |

(Continued)

*Primary Examiner* — Joseph J Dallo
*Assistant Examiner* — Scott A Reinbold
(74) *Attorney, Agent, or Firm* — McCoy Russell LLP

(57) ABSTRACT

Various systems and methods are provided for exhaust gas recirculation. In one example, an exhaust gas recirculation (EGR) system includes an EGR passage coupling an engine exhaust system to an engine intake system, an EGR cooler positioned in the EGR passage, a recirculation passage coupling an outlet of the EGR cooler to an inlet of the EGR cooler, an EGR cooler recirculation valve positioned in the recirculation passage and controllable to change a flow of exhaust gas though the recirculation passage, and a controller configured to adjust a position of the EGR cooler recirculation valve based on a temperature at the inlet of the EGR cooler.

15 Claims, 4 Drawing Sheets

(56) References Cited

U.S. PATENT DOCUMENTS

| | | | | |
|---|---|---|---|---|
| 2007/0267000 | A1* | 11/2007 | Raduenz | F02M 26/32<br>123/568.12 |
| 2009/0277428 | A1 | 11/2009 | Marsh et al. | |
| 2009/0320467 | A1 | 12/2009 | Kardos et al. | |
| 2015/0226108 | A1* | 8/2015 | Vroman | F02B 29/0437<br>60/605.2 |
| 2017/0198664 | A1* | 7/2017 | Bramson | F02M 26/30 |
| 2019/0120178 | A1* | 4/2019 | Park | F02D 41/0077 |

* cited by examiner

SYSTEMS AND METHOD FOR EXHAUST GAS RECIRCULATION

CROSS-REFERENCE TO RELATED APPLICATIONS

The present application is a divisional of U.S. Non-Provisional patent application Ser. No. 15/241,255, entitled "SYSTEMS AND METHOD FOR EXHAUST GAS RECIRCULATION", and filed on Aug. 19, 2016. The entire contents of the above-listed application are hereby incorporated by reference for all purposes.

BACKGROUND

Technical Field

Embodiments of the subject matter disclosed herein relate to engine systems.

Discussion of Art

In order to meet emissions standards mandated by various emissions regulating agencies, internal combustion engines may be configured with various aftertreatment devices, such as selective catalytic reduction systems, and/or with exhaust gas recirculation (EGR) to lower emission production and remove emissions from the exhaust. For example, EGR may reduce peak combustion temperatures, thus lowering NOx emissions. EGR systems may include an EGR cooler configured to cool the engine exhaust gas prior to mixing with intake air in order to further reduce combustion temperatures. The EGR cooler may be a liquid-to-air heat exchanger that cools the EGR via coolant from an engine coolant system, for example. While such a configuration adequately cools the exhaust gas, the thermal gradient across the EGR cooler may be relatively large due to the high exhaust gas temperature and the relatively low-temperature coolant at the inlet of the EGR cooler. This temperature gradient may lead to EGR cooler thermo-mechanical issues, which may result in performance degradation of the engine.

BRIEF DESCRIPTION

In one embodiment, an exhaust gas recirculation (EGR) system includes an EGR passage that couples an engine exhaust system to an engine intake system, an EGR cooler positioned in the EGR passage, a recirculation passage coupling an outlet of the EGR cooler to an inlet of the EGR cooler, and an EGR cooler recirculation valve positioned in the recirculation passage. The EGR cooler recirculation valve is controllable to control a flow of cooled exhaust gas though the recirculation passage. The system further includes a controller that is configured to adjust a position of the EGR cooler recirculation valve based on a temperature of the inlet of the EGR cooler. For example, the controller may be configured to estimate the temperature based on operating conditions, and/or to receive a signal from a temperature sensor that is indicative of the temperature.

DETAILED DESCRIPTION

The following description relates to embodiments of systems for reducing the thermal load on an exhaust gas recirculation (EGR) cooler. In one embodiment, the EGR cooler inlet temperature may be reduced via recirculation of cooled exhaust from outlet of the EGR cooler. By recirculating cooled exhaust, the gas entering the EGR cooler may be at a lower temperature than exhaust gas from the engine outlet, lowering the thermal gradient at the inlet of the EGR cooler.

The approach described herein may be employed in a variety of engine types, and a variety of engine-driven systems. Some of these systems may be stationary, while others may be on semi-mobile or mobile platforms. Semi-mobile platforms may be relocated between operational periods, such as mounted on flatbed trailers. Mobile platforms include self-propelled vehicles. Such vehicles can include on-road transportation vehicles, as well as mining equipment, marine vessels, rail vehicles, and other off-highway vehicles (OHV). For clarity of illustration, a locomotive is provided as an example of a mobile platform supporting a system incorporating an embodiment of the invention.

Figure 1A:
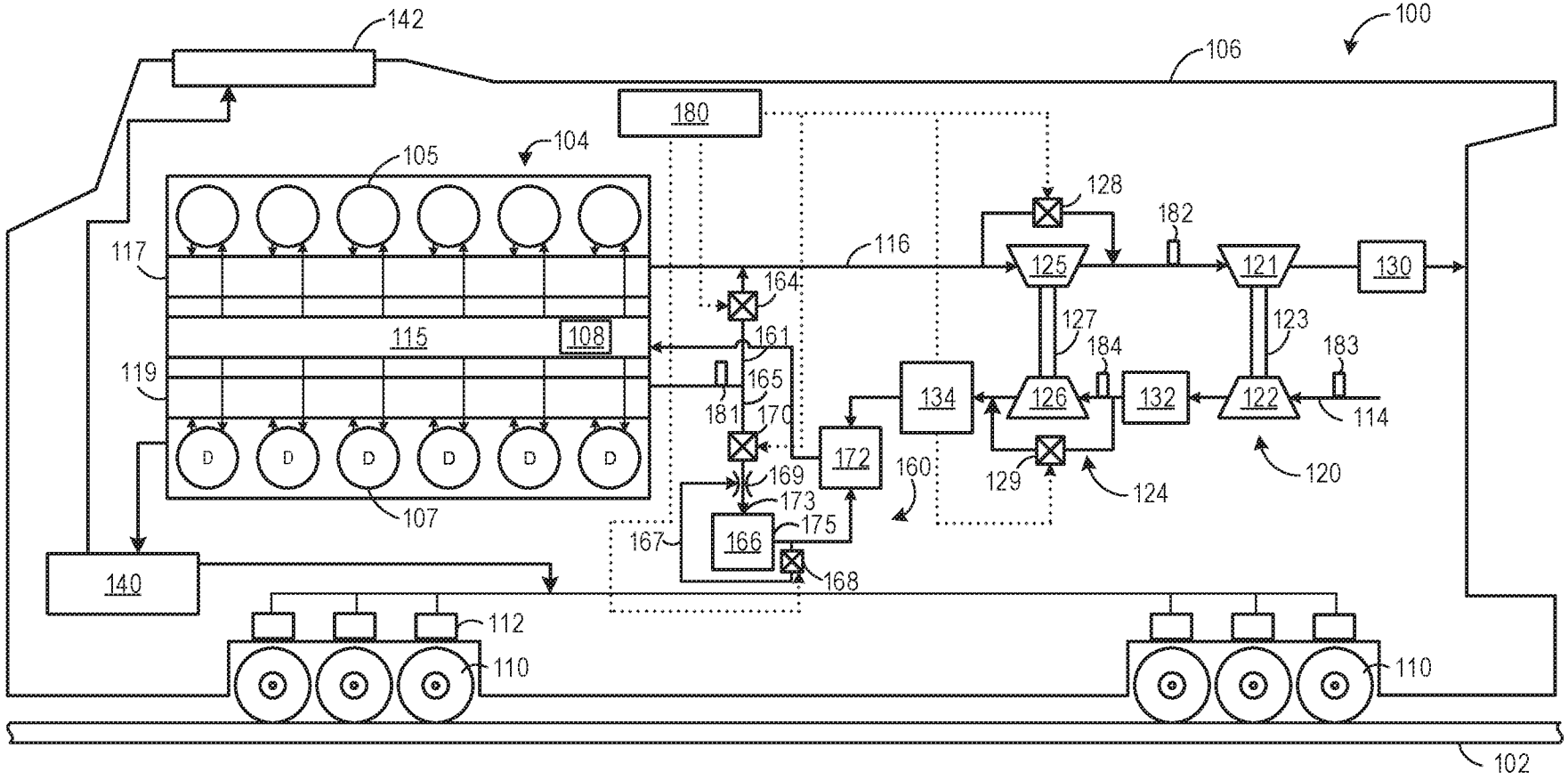
FIG. 1A shows a vehicle system with an EGR system according to an embodiment of the present disclosure.

Before further discussion of the approach for reducing EGR cooler thermal load, an example of a platform is disclosed in which an engine may be configured for a vehicle, such as a rail vehicle. For example, FIG. 1A shows a block diagram of an embodiment of a vehicle system 100 (e.g., a locomotive system), herein depicted as a rail vehicle 106, configured to run on a rail 102 via a plurality of wheels 110. As depicted, the rail vehicle 106 includes an engine 104. In other non-limiting embodiments, the engine 104 may be a stationary engine, such as in a power-plant application, or an engine in a marine vessel or off-highway vehicle propulsion system as noted above.

The engine 104 receives intake air for combustion from an intake, such as an intake manifold 115. The intake may be any suitable conduit or conduits through which gases flow to enter the engine. For example, the intake may include the intake manifold 115, the intake passage 114, and the like. The intake passage 114 receives ambient air from an air filter (not shown) that filters air from outside of a vehicle in which the engine 104 may be positioned. Exhaust gas resulting from combustion inside the engine 104 is supplied to an exhaust, such as exhaust passage 116. The exhaust may be any suitable conduit through which gases flow from the engine. For example, the exhaust may include an exhaust manifold 117, the exhaust passage 116, and the like. Exhaust gas flows through the exhaust passage 116, and out of an exhaust stack of the rail vehicle 106. In one example, the engine 104 is a diesel engine that combusts air and diesel fuel through compression ignition. In other non-limiting embodiments, the engine 104 may combust fuel including gasoline, kerosene, biodiesel, or other petroleum distillates of similar density through compression ignition (and/or spark ignition).

In one embodiment, the rail vehicle 106 is a diesel-electric vehicle. As depicted in FIG. 1A, the engine 104 is coupled to an electric power generation system, which includes an alternator/generator 140 and electric traction motors 112. For example, the engine 104 is a diesel engine that generates a torque output that is transmitted to the alternator/generator 140 which is mechanically coupled to the engine 104. The alternator/generator 140 produces electrical power that may be stored and applied for subsequent propagation to a variety of downstream electrical components. As an example, the alternator/generator 140 may be electrically coupled to a plurality of traction motors 112 and the alternator/generator 140 may provide electrical power to the plurality of traction motors 112. As depicted, the plurality of traction motors 112 are each connected to one of a plurality of wheels 110 to provide tractive power to propel the rail vehicle 106. One example configuration includes one traction motor per wheel. As depicted herein, six pairs of traction motors correspond to each of six pairs of wheels of the rail vehicle. In another example, alternator/generator 140 may be coupled to one or more resistive grids 142. The resistive grids 142 may be configured to dissipate excess engine torque via heat produced by the grids from electricity generated by alternator/generator 140.

In the embodiment depicted in FIG. 1A, the engine 104 is a V-12 engine having twelve cylinders. In other examples, the engine may be a V-6, V-8, V-10, V-16, I-4, I-6, I-8, opposed 4, or another engine type. As depicted, the engine 104 includes a subset of non-donor cylinders 105, which includes six cylinders that supply exhaust gas exclusively to a non-donor cylinder exhaust manifold 117, and a subset of donor cylinders 107, which includes six cylinders that supply exhaust gas exclusively to a donor cylinder exhaust manifold 119. In other embodiments, the engine may include at least one donor cylinder and at least one non-donor cylinder. For example, the engine may have four donor cylinders and eight non-donor cylinders, or three donor cylinders and nine non-donor cylinders. In some examples, the engine may have an equal number of donor and non-donor cylinders. In other examples, the engine may have more donor cylinders than non-donor cylinders. In still further examples, the engine may be comprised entirely of donor cylinders. It should be understood, the engine may have any desired numbers of donor cylinders and non-donor cylinders. Further, in some embodiments, the donor cylinders only supply exhaust gas to the donor cylinder exhaust manifold and not to the non-donor cylinder exhaust manifold. In some embodiments, the non-donor cylinders only supply exhaust gas to the non-donor cylinder exhaust manifold and not to the donor cylinder exhaust manifold.

As depicted in FIG. 1A, the non-donor cylinders 105 are coupled to the exhaust passage 116 to route exhaust gas from the engine to atmosphere (after it passes through first and second turbochargers 120 and 124, and in some embodiments, through aftertreatment system 130). The donor cylinders 107, which feed the engine exhaust gas recirculation (EGR) system, are coupled exclusively to an EGR passage 165 of an EGR system 160 which selectively routes exhaust gas from the donor cylinders 107 to the intake passage 114 of the engine 104 or to atmosphere via the exhaust passage 116. By introducing cooled exhaust gas to the engine 104, the amount of available oxygen for combustion is decreased, thereby reducing combustion flame temperatures and reducing the formation of nitrogen oxides (e.g., NOR). Additional details regarding EGR system 160 will be provided below.

As depicted in FIG. 1A, the vehicle system 100 further includes a two-stage turbocharger with the first turbocharger 120 and the second turbocharger 124 arranged in series, each of the turbochargers 120 and 124 arranged between the intake passage 114 and the exhaust passage 116. The two-stage turbocharger increases air charge of ambient air drawn into the intake passage 114 in order to provide greater charge density during combustion to increase power output and/or engine-operating efficiency. The first turbocharger 120 operates at a relatively lower pressure, and includes a first turbine 121 which drives a first compressor 122. The first turbine 121 and the first compressor 122 are mechanically coupled via a first shaft 123. The first turbocharger may be referred to the "low-pressure stage" of the turbocharger, or in some instances as an LP turbocharger. The second turbocharger 124 operates at a relatively higher pressure, and includes a second turbine 125 which drives a second compressor 126. The second turbocharger may be referred to the "high-pressure stage" of the turbocharger, or HP turbocharger. The second turbine and the second compressor are mechanically coupled via a second shaft 127.

As explained above, the terms "high pressure" and "low pressure" are relative, meaning that "high" pressure is a pressure higher than a "low" pressure. Conversely, a "low" pressure is a pressure lower than a "high" pressure, from a turbine operating pressure point of view.

As used herein, "two-stage turbocharger" may generally refer to a multi-stage turbocharger configuration that includes two or more turbochargers. For example, a two-stage turbocharger may include a high-pressure turbocharger and a low-pressure turbocharger arranged in series, three turbocharger arranged in series, two low pressure turbochargers feeding a high pressure turbocharger, one low pressure turbocharger feeding two high pressure turbochargers, etc. In one example, three turbochargers are used in series. In another example, only two turbochargers are used in series.

In the embodiment shown in FIG. 1A, the second turbocharger 124 is provided with a turbine bypass valve 128 which allows exhaust gas to bypass the second turbocharger 124. The turbine bypass valve 128 may be opened, for example, to divert the exhaust gas flow away from the second turbine 125. In this manner, the rotating speed of the compressor 126, and thus the boost provided by the turbochargers 120, 124 to the engine 104 may be regulated. Additionally, the first turbocharger 120 may also be provided with a turbine bypass valve. In other embodiments, only the first turbocharger 120 may be provided with a turbine bypass valve, or only the second turbocharger 124 may be provided with a turbine bypass valve. Additionally, the second turbocharger may be provided with a compressor bypass valve 129, which allows gas to bypass the second compressor 126 to avoid compressor surge, for example. In some embodiments, first turbocharger 120 may also be provided with a compressor bypass valve, while in other embodiments, only first turbocharger 120 may be provided with a compressor bypass valve.

While not shown in FIG. 1A, in some examples two low-pressure turbochargers may be present. As such, two charge air coolers (e.g., intercoolers) may be present, one positioned downstream of each low-pressure compressor. In one example, the low-pressure turbochargers may be present in parallel, such that charge air that flows through each low-pressure compressor is combined and directed to the high-pressure compressor.

While in the example vehicle system described herein with respect to FIG. 1A includes a two-stage turbocharger, it is to be understood that other turbocharger arrangements are possible. In one example, only a single turbocharger may be present. In such cases, only one charge air cooler may be utilized, rather than the two coolers depicted in FIG. 1A (e.g., intercooler 132 and aftercooler 134). In some examples, a turbo-compounding system may be used, where a turbine positioned in the exhaust passage is mechanically coupled to the engine. Herein, energy extracted from the exhaust gas by the turbine is used to rotate the crankshaft to provide further energy for propelling the vehicle system. Still other turbocharger arrangements are possible.

The vehicle system 100 optionally includes an exhaust treatment system 130 coupled in the exhaust passage 116 in order to reduce emissions and qualify for the emission regulatory norms. As depicted in FIG. 1A, the exhaust gas treatment system 130 is disposed downstream of the turbine 121 of the first (low pressure) turbocharger 120. In other embodiments, an exhaust gas treatment system may be additionally or alternatively disposed upstream of the first turbocharger 120. The exhaust gas treatment system 130 may include one or more components. For example, the exhaust gas treatment system 130 may include one or more of a diesel particulate filter (DPF), a diesel oxidation catalyst (DOC), a selective catalytic reduction (SCR) catalyst, a three-way catalyst, a $NO_x$ trap, and/or various other emission control devices or combinations thereof. However, in some examples the exhaust aftertreatment system 130 may be dispensed with and the exhaust may flow from the exhaust passage to atmosphere without flowing through an after-treatment device.

Additionally, in some embodiments, the EGR system 160 may include an EGR bypass passage 161 that is coupled to EGR passage 165 and is configured to divert exhaust from the donor cylinders back to the exhaust passage. The EGR bypass passage 161 may be controlled via a first valve 164. The first valve 164 may be configured with a plurality of restriction points such that a variable amount of exhaust is routed to the exhaust, in order to provide a variable amount of EGR to the intake.

The flow of exhaust gas to the intake system via EGR passage 165 may be controlled by a second valve 170. For example, when second valve 170 is open, exhaust may be routed from the donor cylinders to one or more EGR coolers (explained in more detail below) and/or additional elements prior to being routed to the intake passage 114. The first valve 164 and second valve 170 may be on/off valves controlled by the control unit 180 (for turning the flow of EGR on or off), or they may control a variable amount of EGR, for example. In some examples, the first valve 164 may be actuated such that an EGR amount is reduced (exhaust gas flows from the EGR passage 165 to the exhaust passage 116). In other examples, the first valve 164 may be actuated such that the EGR amount is increased (e.g., exhaust gas flows from the donor cylinder manifold to the EGR passage 165). In some embodiments, the EGR system may include only one EGR valve, the engine may not include donor cylinders, and/or the EGR system may include other flow control elements to control the amount of EGR.

In the illustrated configuration, the first valve 164 is operable to route exhaust from the donor cylinders to the exhaust passage 116 of the engine 104 and the second valve 170 is operable to route exhaust from the donor cylinders to the intake passage 114 of the engine 104. As such, the first valve 164 may be referred to as an EGR bypass valve, while the second valve 170 may be referred to as an EGR metering valve. Exhaust gas that flows in EGR passage 165 only flows from the donor cylinders and does not flow from the non-donor cylinders; all exhaust from the non-donor cylinders flows to atmosphere via exhaust passage 116. In the embodiment shown in FIG. 1A, the first valve 164 and the second valve 170 may be engine oil, or hydraulically, actuated valves, for example, with a shuttle valve (not shown) to modulate the engine oil. In some examples, the valves may be actuated such that one of the first and second valves 164 and 170 is normally open and the other is normally closed. In other examples, the first and second valves 164 and 170 may be pneumatic valves, electric valves, or another suitable valve.

Exhaust gas flowing from the donor cylinders 107 to the intake passage 114 passes through one or more of heat exchangers such EGR cooler 166 to reduce the temperature of (e.g., cool) the exhaust gas before the exhaust gas returns to the intake passage. The EGR cooler 166 is present in the EGR system because the exhaust gas will be at a very high temperature compared to the inlet air. Mixing a high temperature exhaust gas with low temperature atmospheric air will result in a relatively high temperature air charge entering the engine, and can compromise the engine performance. In one example, EGR cooler 166 may be an air-to-liquid heat exchanger that includes one or more air passages and one or more coolant passages. The air passages are configured to flow EGR while the coolant passages are configured to flow coolant, for example from the engine coolant system. EGR cooler 166 may be counter-flow heat exchanger in one example, where the exhaust gas and coolant flow in opposite directions. While such a configuration may provide adequate cooling of the EGR, the heated coolant near the EGR cooler inlet will be in thermal contact with hot exhaust gas from the engine, thus reducing the heat that may be absorbed by the coolant, compared to the coolant at the inlet of the EGR cooler. Also, the difference in temperatures of the hot coolant and hot exhaust are quite large, which creates a large temperature gradient at the inlet of the EGR cooler. In order to reduce the thermal gradient across the EGR cooler 166, the cooled exhaust gas from downstream of the EGR cooler may be recirculated back to the inlet of the EGR cooler, in order to lower the temperature of the exhaust gas entering the EGR cooler (at the EGR cooler inlet). While in another example, the EGR cooler may be a parallel-flow heat exchanger, where the direction of flow of gas and coolant are parallel (along the same direction). Similar to the counter-flow configuration described above, with the parallel-flow heat exchangers, the hot exhaust gas from the engine meets the cold coolant at the inlet of the EGR cooler, resulting in a higher thermal gradient.

Thus, as shown, a recirculation passage 167 may couple the EGR cooler outlet 175 to the EGR cooler inlet 173. As used herein, EGR cooler inlet may refer to the inlet of the EGR cooler where exhaust gas is received from the engine, while the EGR cooler outlet may refer to the outlet of the EGR cooler where the cooled exhaust gas is expelled into the EGR passage 165. An EGR cooler recirculation valve 168 may be present in recirculation passage 167 in order to control the fraction of cooled exhaust gas recirculated back to the EGR cooler inlet. The EGR cooler recirculation valve 168 may be controlled (via a suitable actuator) according to signals sent by the control unit and may be adjusted responsive to EGR cooler inlet temperature. For example, the EGR cooler recirculation valve may be opened when EGR cooler inlet temperature exceeds a temperature threshold. Because the exhaust gas undergoes a pressure drop across the EGR cooler, the cooled exhaust gas at the EGR cooler outlet may be at a lower pressure than exhaust gas at the EGR cooler inlet. Hence, a venturi 169 or other pressure-regulating device may be present upstream of the EGR cooler inlet. The exhaust gas from the engine, which is at a higher pressure than exhaust gas from the EGR cooler outlet, may act as the motive fluid for venturi 169, thus creating a pressure drop that draws in the lower-pressure cooled exhaust gas in the recirculation passage 167 to the EGR cooler inlet.

The recirculated exhaust gas is at a lower temperature than the exhaust gas from the engine, due to cooling it would have undergone already, in the EGR cooler. Hence, the recirculated EGR may reduce the temperature of the exhaust gas entering the EGR cooler. The amount of recirculated exhaust gas may be adjusted as EGR cooler inlet temperature changes. The EGR cooler recirculation valve position may be adjusted to be more open as the temperature at the EGR cooler inlet increases and may be adjusted to be more closed as the temperature at the EGR cooler inlet decreases. In one example, when EGR cooler inlet temperature is above a threshold temperature, the EGR cooler recirculation valve may be adjusted to recirculate a suitable amount of cooled exhaust gas, such as between 10%-50% of the total cooled exhaust gas volume.

In some examples, one or more charge air coolers, 132 and 134 disposed in the intake passage 114 (e.g., upstream of where the recirculated exhaust gas enters) may be adjusted to further increase cooling of the charge air such that a mixture temperature of charge air and exhaust gas is maintained at a desired temperature. In other examples, the EGR system 160 may include one or more EGR cooler bypasses to bypass the EGR cooler 166. Alternatively, the EGR system may include an EGR cooler control element. The EGR cooler control element may be actuated such that the flow of exhaust gas through the EGR cooler is reduced; however, in such a configuration, exhaust gas that does not flow through the EGR cooler may be directed to the exhaust passage 116 rather than the intake passage 114.

As shown in FIG. 1A, the vehicle system 100 further includes an EGR mixer 172 which mixes the EGR gas with charge air such that the exhaust gas may be evenly distributed within the charge air. In the embodiment depicted in FIG. 1A, the EGR system 160 is a high-pressure EGR system which routes exhaust gas from a location upstream of turbochargers 120 and 124 in the exhaust passage 116 to a location downstream of turbochargers 120 and 124, into the intake passage 114. In other embodiments, the vehicle system 100 may additionally or alternatively include a low-pressure EGR system which routes exhaust gas from downstream of the turbochargers 120 and 124 in the exhaust passage 116, to a location upstream of the turbochargers 120 and 124 in the intake passage 114.

The vehicle system 100 further includes the control unit 180, which is provided and configured to control various components related to the vehicle system 100. In one example, the control unit 180 includes a computer control system. The control unit 180 further includes non-transitory, computer readable storage media (not shown) including code for enabling on-board monitoring and control of engine operation. The control unit 180, while overseeing control and management of the vehicle system 100, may be configured to receive signals from a variety of engine sensors, as further elaborated herein, in order to determine operating parameters and operating conditions, and correspondingly adjust various engine actuators to control operation of the vehicle system 100. For example, the control unit 180 may receive signals from various engine sensors including sensor 181 arranged in EGR passage 165, sensor 182 arranged in the exhaust passage 116, sensor 183 arranged in the inlet of the low-pressure compressor, and sensor 184 arranged in the inlet of the high-pressure compressor. The sensors 181, 182, 183, and 184 may detect temperature and/or pressure. Sensor 108 positioned in the intake manifold 115, may detect intake oxygen concentration or other suitable parameter(s). Additional sensors may include, but are not limited to, engine speed, engine load, boost pressure, ambient pressure, engine temperature, coolant system temperature, etc. Correspondingly, the control unit 180 may control the vehicle system 100 by sending commands to various components such as traction motors, alternator, cylinder valves, throttle, heat exchangers, wastegates or other valves or flow control elements, EGR valves 164 and/or 170, turbine bypass valve 128, EGR cooler recirculation valve 168, etc.

Figure 1B:
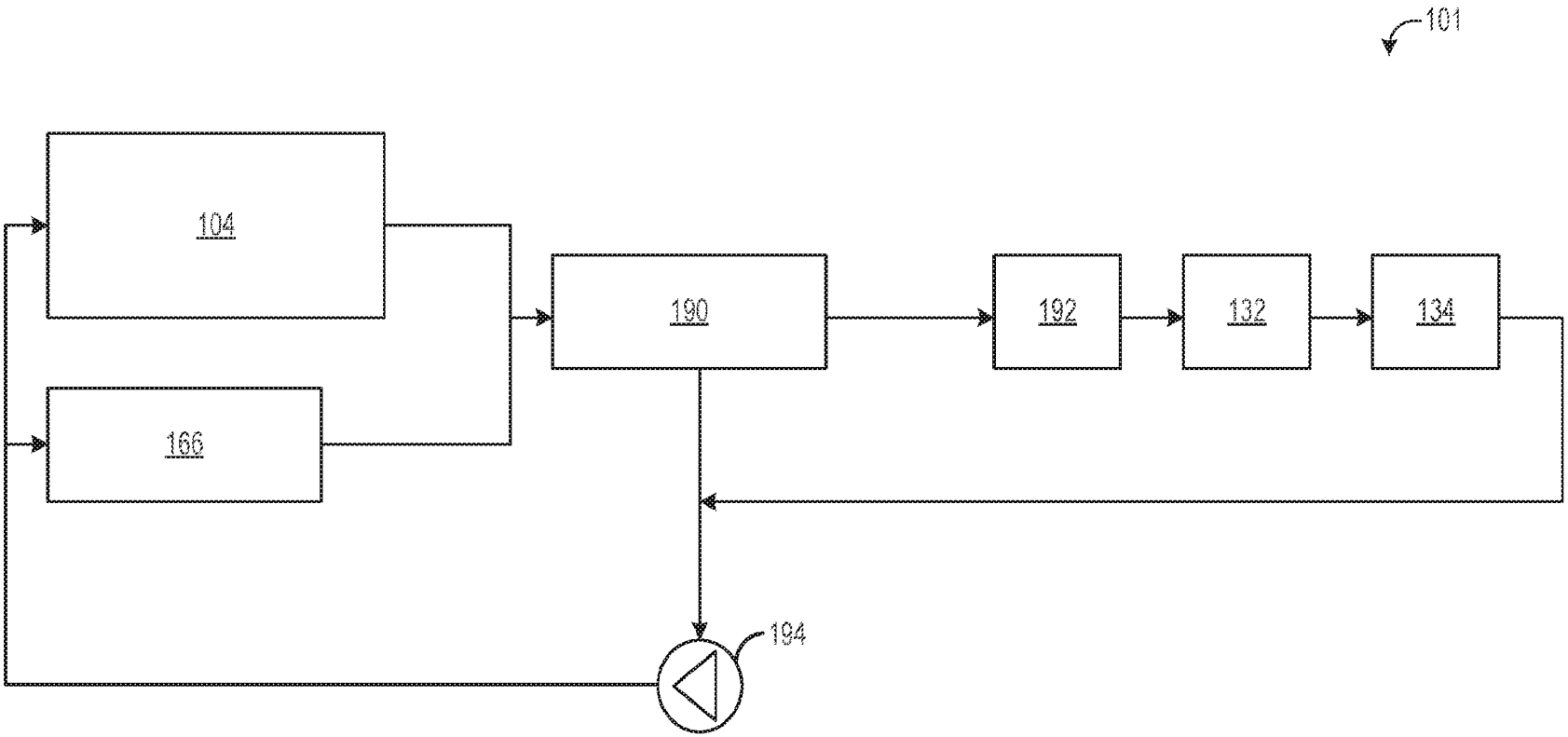
FIG. 1B shows a coolant system for cooling components of the vehicle system of FIG. 1A.

FIG. 1B schematically shows an embodiment of a cooling system 101 that may cool various components of the vehicle system of FIG. 1A. The lines between components in FIG. 1B represents the flow of coolant within the coolant system, which may be water or any other suitable coolant. As shown in FIG. 1B, a coolant pump 194 provides coolant to the engine 104 and the EGR cooler 166 in parallel. Upon exiting the engine, the coolant flows to a radiator 190. Likewise, coolant exiting the EGR cooler also flows to the radiator. The radiator may include one or more heat exchangers (e.g., main radiator and one or more sub-coolers) and may be provided with air (e.g., from a fan) to lower the temperature of the coolant flowing through the radiator.

Coolant that flows though the radiator splits into two main coolant pathways. The first coolant pathway flows directly back to the pump 194. The second coolant pathway flows to various downstream components before flowing to the pump 194, including an oil heat exchanger 192 and the two intercoolers 132, 134. Coolant flowing in the two pathways may be of equal temperature. However, in some examples, coolant that flows from the radiator directly to the pump via the first pathway may be warmer than coolant that flows from the radiator to the downstream components via the second pathway.

Figure 2:
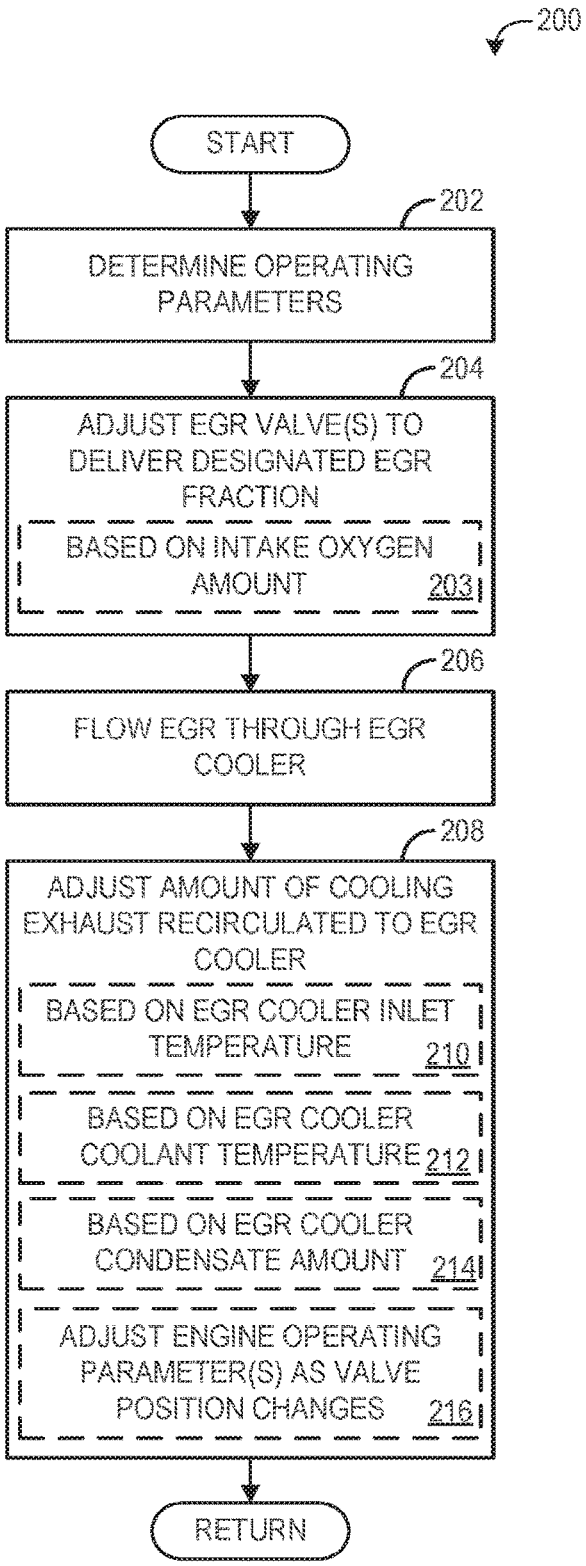
FIG. 2 is a flow chart illustrating an embodiment of a method for controlling an EGR recirculation system.

FIG. 2 is a flow chart illustrating a method 200 for controlling an EGR system, such as the EGR system 160 of FIG. 1A. Method 200 may be carried out by a control unit, such as control unit 180, according to non-transitory instructions stored in memory of the control unit, in combination with one or more sensors and one or more actuators, such as an EGR cooler inlet temperature sensor (e.g., sensor 181) and EGR cooler recirculation valve (e.g., valve 168).

At 202, method 200 includes determining operating parameters. The determined operating parameters may include engine speed, engine load, engine temperature, exhaust gas temperature (as sensed by sensor 181, for example), coolant system coolant temperature, intake oxygen fraction (as sensed by sensor 108, for example) and other parameters. At 204, method 200 includes adjusting one or more EGR valves to deliver a designated exhaust gas fraction to an intake of an engine. One or more EGR valves may include an EGR bypass valve and/or EGR metering valve, such as first valve 164 and second valve 170 of FIG. 1A. The EGR valve(s) may be adjusted to provide an EGR amount (e.g., intake fraction, flow rate, or other suitable amount) based on sensed intake oxygen fraction (from sensor 108, for example) and a target intake oxygen concentration, for example, as indicated at 203. In other examples, the EGR valve(s) may be adjusted based on engine speed, engine load, notch throttle position, or other parameters.

At 206, method 200 includes flowing EGR through an EGR cooler, such as EGR cooler 166 in FIG. 1A. After flowing through the EGR cooler, the cooled exhaust gas is directed to the intake of the engine. At 208, method 200 includes adjusting an amount of cooled exhaust (EGR) recirculated back to the inlet of the EGR cooler. The amount of exhaust from downstream of the EGR cooler that is recirculated back to upstream of the EGR cooler may be controlled via a valve, such as valve 168 of FIG. 1A.

In an example, as indicated at 210, the EGR cooler recirculation valve may be adjusted based on EGR cooler inlet temperature. For example, the EGR cooler inlet may have a maximum temperature, above which degradation to the EGR cooler may occur, particularly when the EGR cooler is exposed to temperatures above the maximum temperature for a prolonged period of time. When the EGR cooler inlet temperature reaches the maximum temperature, or comes within a given range of the maximum temperature (e.g., within 100 degrees C. of the maximum temperature), the EGR cooler recirculation valve may be adjusted to reduce the temperature of the gas entering the EGR cooler. The EGR cooler recirculation valve may be opened in order to recirculate a given fraction of cooled exhaust gas back to the EGR cooler inlet. In an example, the EGR cooler recirculation valve may be opened by a predetermined amount based on the EGR cooler inlet temperature (e.g., the control unit may store a look-up table in memory that outputs an EGR cooler recirculation valve position as a function of EGR cooler inlet gas temperature, and in some examples further based on EGR mass flow as determined by EGR metering valve position and engine load). In another example, the EGR cooler recirculation valve may be opened by a predetermined amount based on engine load (e.g., the control unit may store a look-up table in memory that outputs an EGR cooler recirculation valve position as a function of engine load, throttle position, engine power, or other suitable parameter). Additionally or alternatively, the EGR cooler recirculation valve position may be adjusted in a feedback-controlled manner, such that the EGR cooler recirculation valve is opened progressively until EGR cooler inlet temperature reaches a suitable temperature lower than the maximum temperature. The EGR cooler recirculation valve may be closed, once EGR cooler inlet temperature drops below a second, lower threshold temperature.

In some examples, the amount of cooling exhaust recirculated to the inlet of the EGR cooler may be adjusted based on the temperature of the coolant flowing through the EGR cooler, as indicated at 212. When cooled EGR is recirculated back to the inlet of the EGR cooler, the total heat transferred to the coolant in the EGR cooler may increase. As such, depending on operating conditions and the current temperature of the coolant in the EGR cooler, it may be desirable to increase the coolant temperature by increasing the amount of recirculated cooled exhaust gas, or to decrease the coolant temperature by decreasing the amount of recirculated cooled exhaust gas. For example, referring to the coolant system diagram of FIG. 1B, the coolant that exits the EGR cooler may be cooled at the radiator before being returned to the engine and EGR cooler, or before being directed to downstream components. If the coolant temperature is relatively high, and if ambient temperature is high and the vehicle in which the engine is operating is not moving or moving at a low speed (resulting in low cooling at the radiator), the coolant may not be cooled to an adequate temperature at the radiator, which may lead to engine over-heating, degradation of engine performance and such other issues. Thus, the amount of cooled exhaust gas recirculated to the inlet of the EGR cooler may be reduced when coolant temperature is above a threshold temperature and/or when ambient temperature is above a threshold, vehicle speed is below a threshold, etc. In another example, it may be desirable to rapidly heat the engine and oil cooler during cold start conditions (e.g., where the engine is started at a low ambient temperature) in order to increase engine efficiency. Thus, when coolant temperature is below a threshold temperature, the amount of recirculated cooled exhaust gas may be increased.

Additionally, the EGR cooler may collect condensation due to the exhaust gas having high humidity, and the amount of condensate that collects in the EGR cooler may be particularly high during engine cold start conditions where the EGR cooler surfaces are relatively cool (e.g., cooler than the dew point temperature of the exhaust gas). High levels of condensate in the EGR cooler may be undesirable, as the condensate may degrade the EGR cooler and/or the engine (if large amounts of the condensate are swept to the engine). Because EGR cooler inlet temperature, EGR cooler outlet temperature, and EGR flow rate may each influence the amount of condensate that collects in the EGR cooler, the amount of cooled exhaust gas recirculated to the inlet of the EGR cooler may be adjusted based on the EGR cooler condensate amount, as indicated at 214. For example, if EGR cooler condensate is higher than a threshold level (as determined based on operating parameters such as EGR cooler inlet temperature and EGR cooler coolant temperature) or is predicted to be higher than the threshold level, the amount of cooled exhaust gas recirculated to the EGR cooler inlet may be decreased to increase the temperature of the EGR at the EGR cooler inlet to avoid condensation in the EGR cooler. In another example, if the threshold amount of condensate has formed in the EGR cooler, the EGR cooler recirculation valve position may be adjusted (e.g., opened) to transiently increase mass flow through the EGR cooler, which may act to dislodge the condensate and sweep the condensate to the engine.

Further, in some configurations and/or in some operating conditions, such as at higher engine loads where higher amounts of EGR may be directed to the engine, adjusting the position of the EGR cooler recirculation valve may create a temporary disturbance in the amount of exhaust gas that reaches the engine. For example, if the EGR cooler recirculation valve is fully closed, such that no cooled exhaust gas is recirculated back to the EGR cooler inlet, and then EGR cooler inlet temperature increases to the maximum EGR cooler inlet temperature, the EGR cooler recirculation valve may be commanded to move to a more open position (e.g., such that 10% of the total flow of cooled exhaust gas is recirculated back to the EGR cooler inlet). When the EGR cooler recirculation valve opens, and before the recirculated EGR reaches the EGR cooler inlet and subsequently travels through the EGR cooler again, a drop in the amount of exhaust gas reaching the engine may be observed. Such a transient drop in the EGR amount may be tolerated by the engine in some examples. However, in other examples, one or more engine operating parameters may be adjusted to maintain a steady EGR amount during adjustment of the EGR cooler recirculation valve position.

As such, method 200 may include, at 216, adjusting one or more engine operating parameters as the EGR cooler recirculation valve position changes. The one or more engine operating parameters may include transiently adjusting a position of the EGR metering valve in order to increase the amount of EGR that reaches the EGR cooler inlet, prior to and/or during the time that the EGR cooler recirculation valve is adjusted. The one or more engine operating parameters may additionally or alternatively include boost pressure, which may be adjusted by adjusting a position of a turbine bypass valve, for example. Other operating parameters that may be adjusted include fuel injection timing, intake and/or exhaust valve timing (e.g., to increase internal EGR), and the like. Method 200 then returns.

In this way, the thermal load on the EGR cooler may be reduced by recirculating cooled exhaust gas from the EGR cooler outlet back to the EGR cooler inlet. By doing so, the thermal gradient at an EGR cooler inlet may be reduced, lowering the stresses on the EGR cooler and prolonging the life of the EGR cooler.

Figure 3:
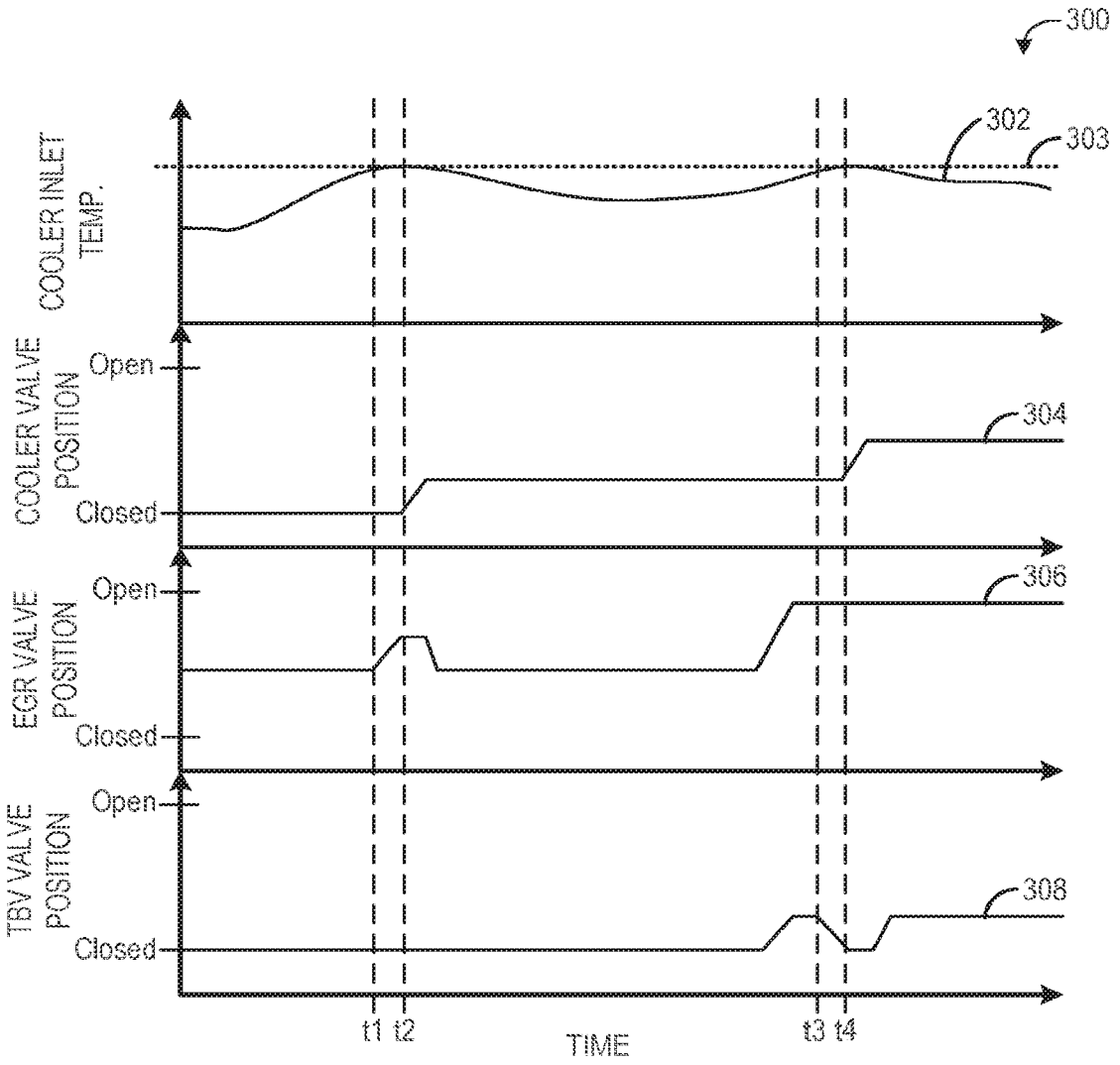
FIG. 3 is a diagram of example operating parameters.

FIG. 3 is a diagram 300 of operating parameters that may be observed during execution of method 200 of FIG. 2, for example. For each plot of diagram 300, time is depicted along the x-axis (horizontal axis) and respective values for each operating parameter are plotted along the y-axis (vertical axis). Diagram 300 illustrates a plot showing EGR cooler gas inlet temperature (represented by curve 302), a plot showing EGR cooler recirculation valve position (represented by curve 304), a plot showing EGR metering valve position (represented by curve 306), and a plot showing turbine bypass valve position (represented by curve 308).

Prior to time t1, exhaust gas is flowing through the EGR cooler and to the engine, as illustrated by the EGR metering valve being partially open. Because the EGR cooler inlet temperature is below a threshold temperature 303 (e.g., maximum temperature), the EGR cooler recirculation valve is fully closed, and no recirculation of cooled exhaust gas occurs. The TBV is fully closed.

At time t1, the EGR cooler inlet temperature increases to the threshold temperature, due to an increase in engine load, warming of the engine after an engine start, or other suitable condition. Responsive to the EGR cooler inlet temperature reaching the threshold temperature, the EGR cooler recirculation valve (shown by curve 304) is opened at time t2. However, to prevent a transient drop in EGR gas flow rate at the engine, when the EGR cooler recirculation valve opens, the amount of EGR directed from the engine to the EGR cooler may be temporarily increased before the EGR cooler recirculation valve is opened, as shown by the adjustment of the position of the EGR metering valve (shown by curve 306). Once the EGR cooler recirculation valve is opened and cooled EGR is recirculated back to the EGR cooler, the EGR cooler inlet temperature decreases to a temperature below the threshold.

Prior to time t3, engine load may increase, resulting in an increase in the amount of EGR directed to the engine (and hence the EGR metering valve being moved to a more open position). To prevent an over-boost condition, the turbine bypass valve may be opened. Due to the increased EGR flow rate into the engine and engine load, the EGR cooler inlet temperature may again reach the threshold temperature at time t3, and as a result the EGR cooler recirculation valve may be opened by a larger amount at time t4 to further reduce the temperature at the EGR cooler gas inlet. Because the EGR rate is already relatively high, rather than further adjusting the EGR metering valve to prevent a transient drop in EGR, the turbine bypass valve may instead by adjusted to compensate for the reduction in EGR that reaches the engine as the EGR cooler recirculation valve is opened. As shown, at time t3 and prior to the EGR cooler recirculation valve opening more, the turbine bypass valve is transiently closed to increase boost pressure during the opening of the EGR cooler recirculation valve.

An embodiment relates to an exhaust gas recirculation (EGR) system. The system includes an EGR passage coupling an engine exhaust system to an engine intake system; an EGR cooler positioned in the EGR passage; a recirculation passage, coupling an outlet of the EGR cooler to an inlet of the EGR cooler; an EGR cooler recirculation valve positioned in the recirculation passage and controllable to change a flow of exhaust gas though the recirculation passage; and a controller configured to adjust a position of the EGR cooler recirculation valve based on a temperature at the inlet of the EGR cooler.

In an example, the controller is configured to receive, from a temperature sensor, a signal indicative of a temperature of the inlet of the EGR cooler and to open the EGR cooler recirculation valve responsive to the temperature exceeding a threshold temperature. In another example, the controller is configured to estimate the temperature at the inlet of the EGR cooler as a function of engine output and to open the EGR cooler recirculation valve responsive to the temperature exceeding a threshold temperature.

The system may further include an EGR valve positioned to control flow of exhaust gas through the EGR passage. The controller may be configured to adjust a position of the EGR valve based on a target intake oxygen fraction. The controller may be configured to further adjust the position of the EGR valve based on one or more of the temperature at the inlet of the EGR cooler or a position of the EGR cooler recirculation valve.

The system may further include a turbocharger including a turbine positioned in the engine exhaust system and a compressor positioned in the engine intake system, an amount of boost pressure created by the turbocharger controlled by a turbine bypass valve coupled across the turbine, and the controller may be configured to adjust a position of the turbine bypass valve based on one or more of the temperature at the inlet of the EGR cooler or a position of the EGR cooler recirculation valve.

The system may further include a venturi fluidically coupling the EGR passage and recirculation passage to the inlet of the EGR cooler. The EGR cooler may be an air-to-liquid EGR cooler comprising one or more coolant passages configured to flow coolant and one or more air passages configured to flow the exhaust gas.

An embodiment of a method includes directing exhaust gas from an exhaust manifold of an engine to an inlet of an exhaust gas recirculation (EGR) cooler and directing exhaust gas from an outlet of the EGR cooler to an intake manifold of the engine; and selectively directing a portion of the exhaust gas from the outlet of the EGR cooler to the inlet of EGR cooler.

Selectively directing a portion of the exhaust gas from the outlet of the EGR cooler to the inlet of EGR cooler may include selectively opening an EGR cooler recirculation valve positioned in a recirculation passage coupled across the EGR cooler. Selectively opening the EGR cooler recirculation valve may include opening the EGR cooler recirculation valve responsive to a temperature at the inlet of the EGR cooler exceeding a threshold temperature.

The method may further include transiently increasing boost pressure responsive to the temperature at the inlet of the EGR cooler exceeding the threshold temperature. Directing exhaust gas from the exhaust manifold to the inlet of the EGR cooler may include adjusting a position of one or more EGR valves to reach a target intake oxygen fraction. The method may further include directing cooling system coolant to one or more coolant passages of the EGR cooler.

An embodiment of a system includes an engine having a first subset of cylinders and a second subset of cylinders; a first exhaust manifold coupled to the first subset of cylinders and a second exhaust manifold coupled to the second subset of cylinders; an EGR passage coupling the first exhaust manifold to an intake manifold of the engine; an EGR cooler positioned in the EGR passage; a recirculation passage coupling the EGR passage downstream of the EGR cooler to the EGR passage upstream of the EGR cooler via a venturi;

an EGR cooler recirculation valve positioned in the recirculation passage; and a controller configured to adjust a position of the EGR cooler recirculation valve based on a temperature at an inlet of the EGR cooler.

The system may further include an exhaust passage coupling the first exhaust manifold and the second exhaust manifold to a turbocharger turbine. The system may further include an EGR metering valve controlling flow of exhaust from the first exhaust manifold to the EGR passage and an EGR bypass valve controlling flow of exhaust from the first exhaust manifold to the exhaust passage. The controller may be configured to adjust the position of the EGR cooler recirculation valve to be more open as the temperature at the inlet of the EGR cooler increases. The controller may be configured to adjust a position of the EGR cooler recirculation valve based on an amount of condensate in the EGR cooler.

As used herein, an element or step recited in the singular and proceeded with the word "a" or "an" should be understood as not excluding plural of said elements or steps, unless such exclusion is explicitly stated. Furthermore, references to "one embodiment" of the invention do not exclude the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A method, comprising:

directing exhaust gas from an exhaust manifold of an engine to an inlet of an exhaust gas recirculation (EGR) cooler and directing exhaust gas from an outlet of the EGR cooler to an intake manifold of the engine; and selectively directing a portion of the exhaust gas from the outlet of the EGR cooler to the inlet of EGR cooler.

2. The method of claim 1, wherein selectively directing a portion of the exhaust gas from the outlet of the EGR cooler to the inlet of EGR cooler comprises selectively opening an EGR cooler recirculation valve positioned in a recirculation passage coupled across the EGR cooler.

3. The method of claim 2, wherein selectively opening the EGR cooler recirculation valve comprises opening the EGR cooler recirculation valve responsive to a temperature at the inlet of the EGR cooler exceeding a threshold temperature.

4. The method of claim 3, further comprising transiently increasing boost pressure responsive to the temperature at the inlet of the EGR cooler exceeding the threshold temperature.

5. The method of claim 1, wherein directing exhaust gas from the exhaust manifold to the inlet of the EGR cooler comprises adjusting a position of one or more EGR valves to reach a target intake oxygen fraction.

6. The method of claim 1, further comprising directing cooling system coolant to one or more coolant passages of the EGR cooler.

7. The method of claim 1, wherein selectively directing a portion of the exhaust gas from the outlet of the EGR cooler to the inlet of EGR cooler comprises selectively opening an EGR cooler recirculation valve positioned in a recirculation passage coupled across the EGR cooler, and wherein directing exhaust gas from the exhaust manifold to the inlet of the EGR cooler comprises adjusting a position of one or more EGR valves to reach a target intake oxygen fraction.

8. A system, comprising:

an engine;

an exhaust manifold coupled to the engine;

an intake manifold coupled to the engine;

an EGR passage coupling the exhaust manifold to the intake manifold;

an EGR cooler, wherein the EGR cooler is positioned in the EGR passage for exhaust gas from the exhaust manifold to be directed to an inlet of the EGR cooler and exhaust gas from an outlet of the EGR cooler to be directed to the intake manifold; and a recirculation passage configured to selectively direct a portion of the exhaust gas from the outlet of the EGR cooler to the inlet of EGR cooler.

9. The system of claim 8, wherein the recirculation passage couples the EGR passage downstream of the EGR cooler to the EGR passage upstream of the EGR cooler via a venturi.

10. The system of claim 8, further comprising an EGR cooler recirculation valve positioned in the recirculation passage, and wherein the EGR cooler recirculation valve is configured to selectively open to selectively direct the portion of the exhaust gas from the outlet of the EGR cooler to the inlet of EGR cooler.

11. The system of claim 10, wherein the EGR cooler recirculation valve is configured to selectively open responsive to a temperature at the inlet of the EGR cooler exceeding a threshold temperature.

12. The system of claim 11, further comprising a turbocharger configured to transiently increase a boost pressure of the engine responsive to the temperature at the inlet of the EGR cooler exceeding the threshold temperature.

13. The system of claim 8, further comprising one or more EGR valves, and wherein a position of the one or more EGR valves configured to be adjusted based on a target intake oxygen fraction to direct the exhaust gas from the exhaust manifold to the inlet of the EGR cooler and the exhaust gas from the outlet of the EGR cooler to the intake manifold.

14. The system of claim 8, further comprising a cooling system, wherein coolant from the cooling system is configured to be directed to one or more coolant passages of the EGR cooler.

15. A system, comprising:

an engine;

an exhaust manifold coupled to the engine;

an intake manifold coupled to the engine;

an EGR passage coupling the exhaust manifold to the intake manifold;

an EGR cooler, wherein the EGR cooler is positioned in the EGR passage for exhaust gas from the exhaust manifold to be directed to an inlet of the EGR cooler and exhaust gas from an outlet of the EGR cooler to be directed to the intake manifold;

a recirculation passage coupling the EGR passage downstream of the EGR cooler to the EGR passage upstream of the EGR cooler via a venturi;

an EGR cooler recirculation valve positioned in the recirculation passage; and a controller configured to control the EGR cooler recirculation valve to selectively direct a portion of the exhaust gas from the outlet of the EGR cooler to the inlet of the EGR cooler via the recirculation passage.

* * * * *